US010618339B2

(12) United States Patent
Landertshamer et al.

(10) Patent No.: US 10,618,339 B2
(45) Date of Patent: Apr. 14, 2020

(54) METHOD FOR PRODUCING A SECURITY ELEMENT

(71) Applicant: HUECK FOLIEN GESELLSCHAFT M.B.H., Baumgartenberg (AT)

(72) Inventors: Sonja Landertshamer, Linz (AT); Stephan Trassl, Baumgartenberg (AT)

(73) Assignee: Hueck Folien Gesellschaft M.B.H., Baumgartenberg (AT)

( * ) Notice: Subject to any disclaimer, the term of this patent is extended or adjusted under 35 U.S.C. 154(b) by 0 days.

(21) Appl. No.: 15/765,366

(22) PCT Filed: Oct. 3, 2016

(86) PCT No.: PCT/EP2016/073582
§ 371 (c)(1),
(2) Date: Jun. 21, 2018

(87) PCT Pub. No.: WO2017/055634
PCT Pub. Date: Apr. 6, 2017

(65) Prior Publication Data

US 2018/0304670 A1 Oct. 25, 2018

(30) Foreign Application Priority Data

Oct. 2, 2015 (EP) ..... 15188216

(51) Int. Cl.
*B42D 25/328* (2014.01)
*B42D 25/435* (2014.01)
(Continued)

(52) U.S. Cl.
CPC ..... *B42D 25/328* (2014.10); *B42D 25/29* (2014.10); *B42D 25/373* (2014.10);
(Continued)

(58) Field of Classification Search
CPC .... B42D 25/328; B42D 25/435; B42D 25/29; B42D 25/425; B42D 25/45; B42D 25/373
(Continued)

(56) References Cited

U.S. PATENT DOCUMENTS

2010/0320742 A1* 12/2010 Hoffmuller ..... D21H 21/42 283/70

FOREIGN PATENT DOCUMENTS

DE 4404128 A1 8/1994
DE 102008008685 A1 8/2009
(Continued)

*Primary Examiner* — Justin V Lewis

(57) ABSTRACT

A method for producing a security element with a metallized optical diffraction structure in an embossed coating layer in which a coating layer is applied onto a support, then embossed and cured; structural depressions, structural elevations, and an optical diffraction structure are produced by embossing the coating layer, then a reflective layer is provided on the structural depressions and structural elevations of the embossed coating layer by means of metallization, and after that, this reflective layer is selectively demetallized. The optical diffraction structure is embossed into at least one structural elevation and the selective demetallization includes a bonding of at least the metallized structural elevation that has the optical diffraction structure to a transfer support and then a separation of this structural elevation bonded to a transfer support both from the support and from at least one metallized structural depression adjoining this structural elevation through removal of the transfer support from the support.

14 Claims, 3 Drawing Sheets

(51) Int. Cl.

| | |
|---|---|
| ***B42D 25/29*** | (2014.01) |
| ***B42D 25/373*** | (2014.01) |
| ***B42D 25/425*** | (2014.01) |
| ***B42D 25/45*** | (2014.01) |

(52) U.S. Cl.
CPC ..... *B42D 25/425* (2014.10); *B42D 25/435* (2014.10); *B42D 25/45* (2014.10)

(58) Field of Classification Search
USPC ..... 283/67, 70, 72, 83, 94, 901
See application file for complete search history.

(56) References Cited

FOREIGN PATENT DOCUMENTS

| | | | |
|---|---|---|---|
| EP | 0563992 | A2 | 10/1993 |
| EP | 1843901 | B1 | 1/2014 |

* cited by examiner

METHOD FOR PRODUCING A SECURITY ELEMENT

FIELD OF THE INVENTION

The invention relates to a method for producing a security element with a metallized optical diffraction structure in an embossed coating layer, in which a coating layer is applied onto a support, then embossed and cured; structural depressions, structural elevations, and an optical diffraction structure are produced by means of the embossing of the coating layer, then a reflective layer is provided on the structural depressions and structural elevations of the embossed coating layer by means of metallization, and after that, this reflective layer is selectively demetallized

BACKGROUND OF THE INVENTION

In order to selectively demetallize metallic reflective layers to produce security elements, it is known (EP1843901B1) to vaporize subregions of these reflective layers by acting on them with laser radiation. The positioning accuracy of the laser radiation is improved in that the subregion that is to be demetallized has a different contour on structural depressions and structural elevations than is the case in subregions that are not to be demetallized. Before being metallized, these structural depressions and structural elevations are embossed in a coating layer that is applied to a support and is then cured. In addition, optical diffraction structures can also be embossed into this coating layer. This does allow the selective demetallization with the aid of a laser radiation to be performed in a quick and still positionally accurate way, but this disadvantageously also requires a considerable complexity in the preceding embossing step in order to prepare the subregions with different laser interactions from one another. In addition, a provision of such subregions is often simply not possible due to the presence of predetermined embossed structures on the security element so that this step not only makes such methods comparatively complex, but also restricts their usability.

SUMMARY OF THE INVENTION

The object of the invention, therefore, is to create a method for producing a security element with a metallized optical diffraction structure of the type described at the beginning, which is simple and flexible to use and produces a precise security element in a reproducible way.

The invention attains the object in that the optical diffraction structure is embossed into at least one structural elevation and in that the selective demetallization includes a bonding of at least the metallized structural elevation that has the optical diffraction structure to a transfer support and then a separation of this structural elevation bonded to a transfer support both from the support and from at least one metallized structural depression adjoining this structural elevation through removal of the transfer support from the support.

If the optical diffraction structure is embossed into at least one structural elevation of the coating layer, then because of the transition between the structural elevation and the adjacent structural depression, the coating layer can be divided into comparatively sharply delimited subregions in a simple way from a process standpoint. As a result, a subsequent selective demetallization of the metallized, embossed coating layer or a demetallization of a subregion of the metallized, embossed coating layer can be facilitated if this selective demetallization includes a bonding of at least the metallized structural elevation that has the optical diffraction structure to a transfer support and then a separation of this structural elevation bonded to a transfer support both from the support and from at least one metallized structural depression adjoining this structural elevation through removal of the transfer support from the support. According to the invention, the metallization in the region of the diffraction structure can thus be demetallized in an extremely reproducible, precise, and positionally accurate fashion and an unwanted demetallization of the reflective layer on the structural elevations can be avoided. For example, inspection regions, cutouts, interruptions, openings, etc. that precisely adjoin the diffraction structure can thus be produced on the security element, which can significantly improve the level of forgery protection that it provides. In addition, it is thus possible to produce a reflective layer that is congruent with the structural elevations—in particular a reflective layer that is congruent with the optical diffraction structure on the structural elevation. It is therefore possible to achieve an extremely reproducible, but nevertheless inexpensive method for producing a forgery-proof security element.

It should be noted in general that the structural elevations that are bonded to the transfer support and remain on it can subsequently constitute the security element or a part of it. For this purpose, the structural elevations bonded to the transfer support can be subjected to additional method steps such as additional coatings, etc. In general, it should be further noted that the coating layer can be any layer that is based on thermoplastic polymers, for example PMMA, acrylates, PVC, PU, or similar materials. The coating layer can furthermore be composed of radically or cationically cured UV coatings, which are based on polyester-, PU-, or acrylate bonding agents, among other things.

If the coating layer is also applied to the support in the form of a liquid or paste-like coating and subsequently embossed and cured, then the method can be further accelerated and simplified. Due to the liquid or paste-like consistency of the coating, it is also possible to achieve a homogeneous, integral bond to the support and a more uniform filling of the embossing tool, which can further increase the reproducibility of the method.

The simplicity of the method can be further increased if the coating layer is cured, in particular polymerized, during the embossing. It is thus possible in a particularly quick and simple way to comply with strict production tolerances with regard to the embossed structure. In addition, the production parameters—such as curing time, contact time with the embossing tool, etc.—can be flexibly adjusted, which can further increase the reproducibility. It should be noted in general that the curing or polymerization of the coating layer can be carried out by means of UV radiation. An irradiation through the support during the embossing is possible, for example, with UV-transparent support films. The irradiation can, however, also be performed from the embossing tool side.

If the coating layer is embossed with a rotating embossing tool, then this can further improve the continuity of the method. In addition, the rotating embossing tool can achieve a virtually impact-free embossing of the coating layer. This can make the method simpler and more reproducible.

If at least one diffraction structure that is embossed into a structural elevation forms a hologram, then a security element with a particularly good security effect can be produced in a simple way from a process standpoint. In this case, the hologram can already be embossed into the structural elevations with high precision by the embossing tool, making it possible to avoid additional method steps. It is thus possible to achieve a method with a high degree of reproducibility.

The reproducibility of the method can be increased significantly if the thickness of the reflective layer is less than the embossing depth of the structural depressions. It is thus possible to reliably prevent the reflective layers of the structural depressions and structural elevations from forming an overlap with one another. Among other things, such an overlap could result in an uncontrollable breach of the reflective layer during the separation, which can result in ill-defined contours in the reflective layer on the structural elevations.

If the optical diffraction structures embossed into the structural elevations have less of an embossing depth than the structural depressions, then it is possible to ensure a reliable demetallization by the separation of the structural elevations from the structural depressions during the removal of the support. It is thus possible to reliably prevent parts of the diffraction structures, in particular parts of the coating layer that form the structural elevations, from being removed along with the demetallization and thus destroying the diffraction structure. It is therefore possible to achieve a particularly reliable and reproducible method. This also makes it possible to achieve strict production tolerances.

The selective demetallization by the separation of the structural elevations from the structural depressions can be improved significantly if the embossing depth of the structural depressions in the coating layer essentially corresponds to the coating layer thickness. It is thus specifically possible to weaken the bond between the structural elevations and the structural depressions to be separated from them at the same time as they are metallized—which can not only facilitate the removal of the transfer support, but also ensure an exact, sharp-edged demetallization. This is particularly true if the structural depressions are embossed through to the support. This can yield a particularly simple and reproducible method.

If an adhesion reducer is applied to the support before the coating layer, then it is possible to further facilitate the separation of the structural elevations from the structural depressions. In particular, adhesion reducers can prove to be of value in this connection, the use of which results in a lower adhesion force between the support and the coating layer than between the reflective layer and the support when the coating layer has been embossed through to the support for this purpose. A particularly simple demetallization can be achieved by means of this and the reliability of the method can be increased further as a result.

If in addition, the transfer support is coated with an adhesion promoter before being bonded to the structural elevations, then it is possible to ensure that the structural elevations form a durable bond with the transfer support by means of the reflective layer. It is thus possible to durably prevent an unwanted detachment of the structural elevations from transfer support as the support is being removed from the security element with the transfer support. It is thus possible to further increase the reproducibility of the method.

If the security element is provided with a protective coating layer after being removed from the support, then this can facilitate the subsequent treatment of the security element in the method. In this case, the protective coating layer can also compensate for the irregularities that are produced by means of the structural depressions and thus produce a homogeneous, flat surface for further processing steps. In addition, the protective coating layer can reliably protect the security element from external influences such as oxidation of the metallic reflective layer. For example, the protective coating layer can be a transparent coating layer. It is likewise conceivable that the protective coating layer can also be an adhesive layer in order to be able to provide the security element on a security document in a user-friendly way. Such an adhesive layer can, for example, be a hot-seal coating, cold-seal coating, or self-adhesive coating. The adhesive layer can likewise also be applied with a protective coating layer.

The level of forgery protection of the security element can be additionally increased if the security element is provided with additional security features. This can take place, for example, by gluing (or laminating) the security element according to the invention to another security element that has different security features.

The security element can be bonded to a security document in a user-friendly way, for example by being glued to the security document. A lamination to the latter is also conceivable. It should be noted in general that a security document can, for example, be a passport, a personal ID card, a driver's license, a banknote, a credit card, or the like.

BRIEF DESCRIPTION OF THE DRAWINGS

The subject of the invention is shown in greater detail in the drawings based on one embodiment variant as an example. In the drawings.

DETAILED DESCRIPTION OF THE PREFERRED EMBODIMENTS

Figure 1:
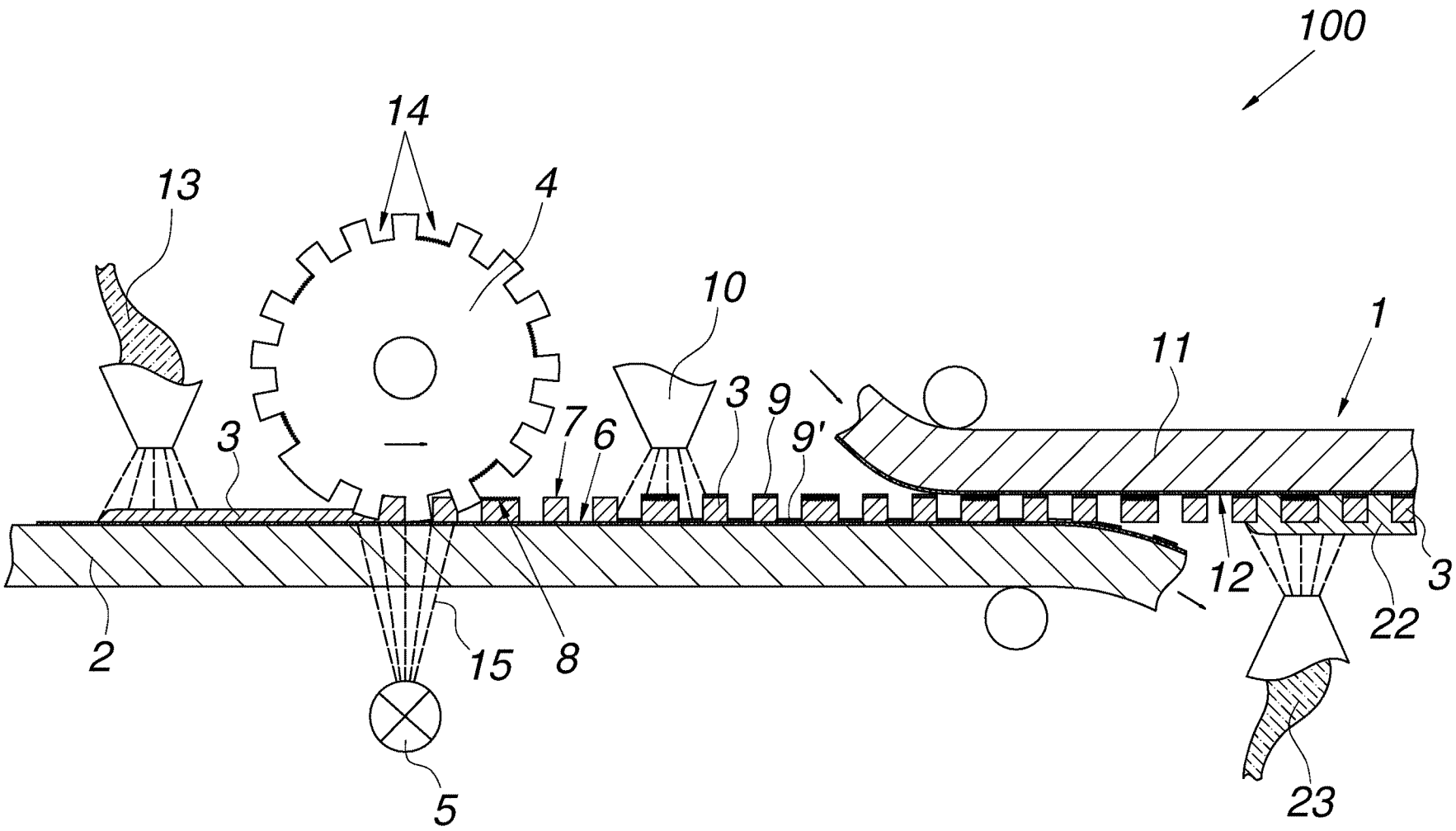
FIG. 1 is a schematic depiction of the method according to the invention.

FIG. 1 shows a method 100 for producing a security element 1. In this case, in a first step, a coating layer 3 is applied to a support 2, which coating layer 3 is embossed with an embossing tool 4 in another step and then—shown subsequently here—is cured. The curing is schematically depicted by way of example in the form of a radiation source 5. The embossing produces structural depressions 6 and structural elevations 7 in the coating layer 3. In addition, after the embossing, the coating layer 3 has optical diffraction structures 8. In another step, the coating layer 3 is metallized in order to produce a reflective layer 9, 9'—the metallization produces a reflective layer 9, 9' on both the structural depressions 6 and the structural elevations 7. The metallization is carried out, as shown in FIG. 1, with a conventional metal-depositing method 10. Subsequently in the process, the reflective layer 9, 9' is selectively removed, particularly from the structural depressions 6 of the coating layer 3, and thus demetallized.

Figure 2:
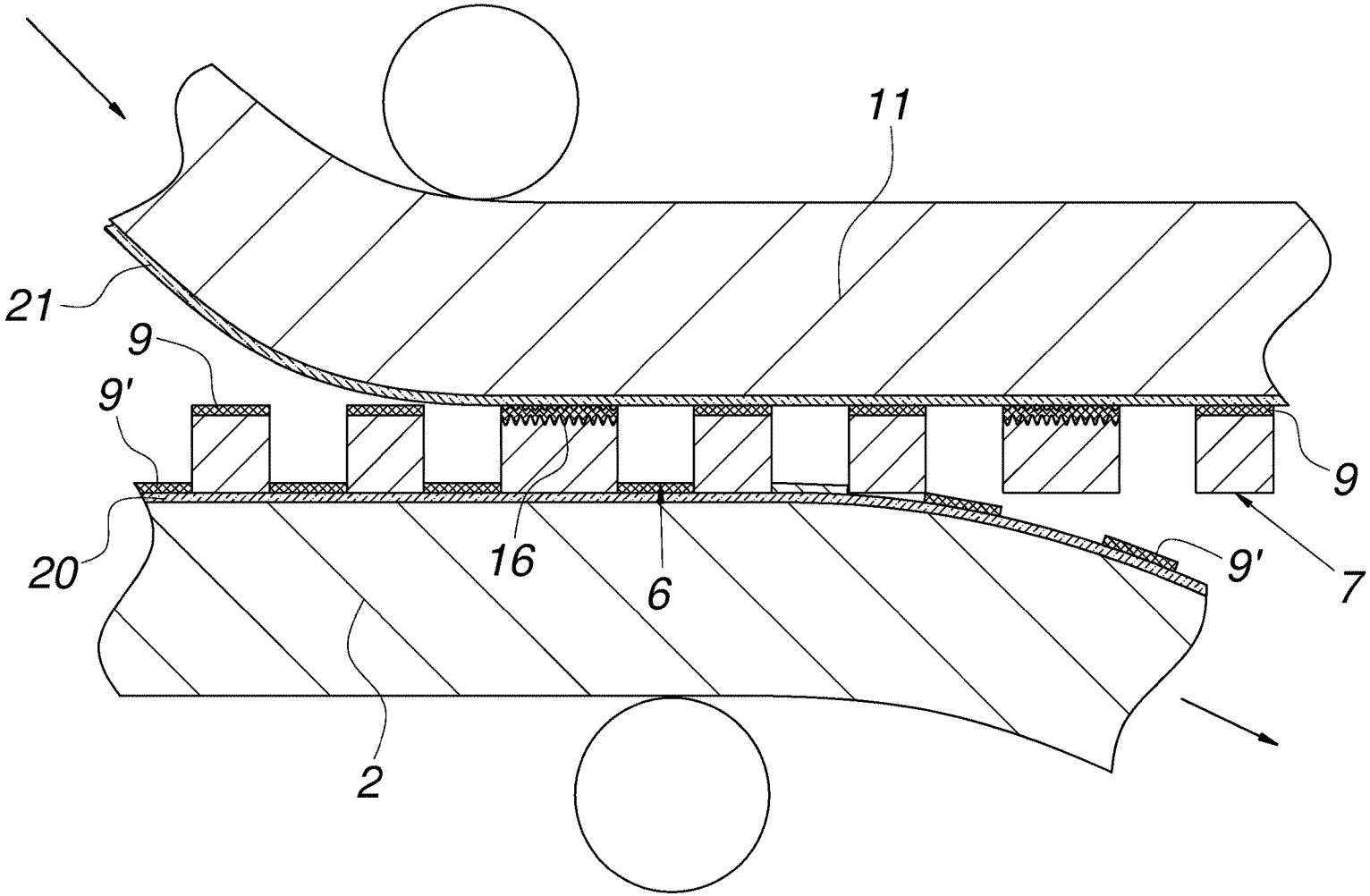
FIG. 2 shows a detail of the separation procedure of the method from FIG. 1.

According to the invention, in order to selectively demetallize the reflective layer 9, 9' the structural elevations 7 of the coating layer 3, which in particular have a reflective layer 9, are integrally bonded to a transfer support 11, as can be seen in detail in FIG. 2. To this end, the transfer support 11, which functions as a new substrate of the security element 1, is brought into a bond with the structural elevations 7 of the coating layer 3 on the support 2. But a bond between the structural depressions 6 of the coating layer 3 and the transfer support 11 is not produced. In another step, the original support 2 is then removed from the security element 1 and in the process of this, the structural elevations 7 that are bonded to the transfer support 11 are separated from the metalized structural depressions 6 adjacent to them. The structural depressions 6 in this case continue to adhere to the original support 2 and are removed from the transfer support 11 along with it in order to produce the security element 1. In particular, the regions of the reflective layer 9' that are situated in the structural depressions 6 are removed along with the support 2. The removal of the support 2 from the transfer support 11 selectively demetallizes the reflective layer 9 of the security element 1 on the transfer support 11 in the regions of the structural depressions 6 by removal of the reflective layer 9'. As a result, a reflective layer 9 can be produced, which is exactly congruent with the structural elevations 7 of the coating layer 3. Since a diffraction structure 8 is embossed into at least one of these structural elevations 7—for example with the aid of the embossing tool 4—, an exactly congruent metallization of the diffraction structure 8 is thus also achieved. Regions between the structural elevations 7 therefore function as inspection regions 12 through the reflective layer 9, which constitute an exact security feature on the security element 1 and achieve a high level of forgery protection.

As is also apparent in FIG. 1, the coating layer 3 is applied to the support 2 in the form of a liquid or paste-like coating 13. Due to the liquid or paste-like consistency of the coating 13, the cavities 14 of the embossing tool 4 can be better filled and a more homogeneous and more exact embossing can be achieved. In addition, sharply delimited structural elevations 7 can be achieved. The coating layer 3 or more precisely, the liquid or paste-like coating 13 that forms the coating layer 3, is cured during the contact with the embossing tool 4. This is likewise apparent in FIG. 1. To achieve this, a schematically depicted radiation source 5 is provided under the embossing tool 4 and cures the coating layer 3 by means of a suitable radiation 15 during the contact with the embossing tool 4. In this case, a UV lamp is advantageously used as a radiation source 5; the UV radiation 15 emitted by the lamp can polymerize the coating 13. In particular, the embossing tool 4 is a rotating embossing tool 4, which improves the periodicity of the embossed structure and avoids a repetitive impact in the embossed structure. The curing of the coating layer 3 during the contact with the rotating embossing tool 4 can achieve a higher embossing precision, which achieves a by and large more rugged and reproducible method.

The thickness of the reflective layer 9, 9' on the structural elevations 7 and structural depressions 6 is advantageously less than the embossing depth 17 of the structural depressions 6. This prevents the reflective layer 9 and reflective layer 9' from overlapping, which would require powerful cohesion of the metallic reflective layers 9, 9'. But if the reflective layer 9, 9' is significantly thinner than the embossing depth 17 of the structural depressions 6, then it is possible to ensure a simple removal of the reflective layers 9' from the coating layer 3 as the separation is being carried out.

Figure 3:
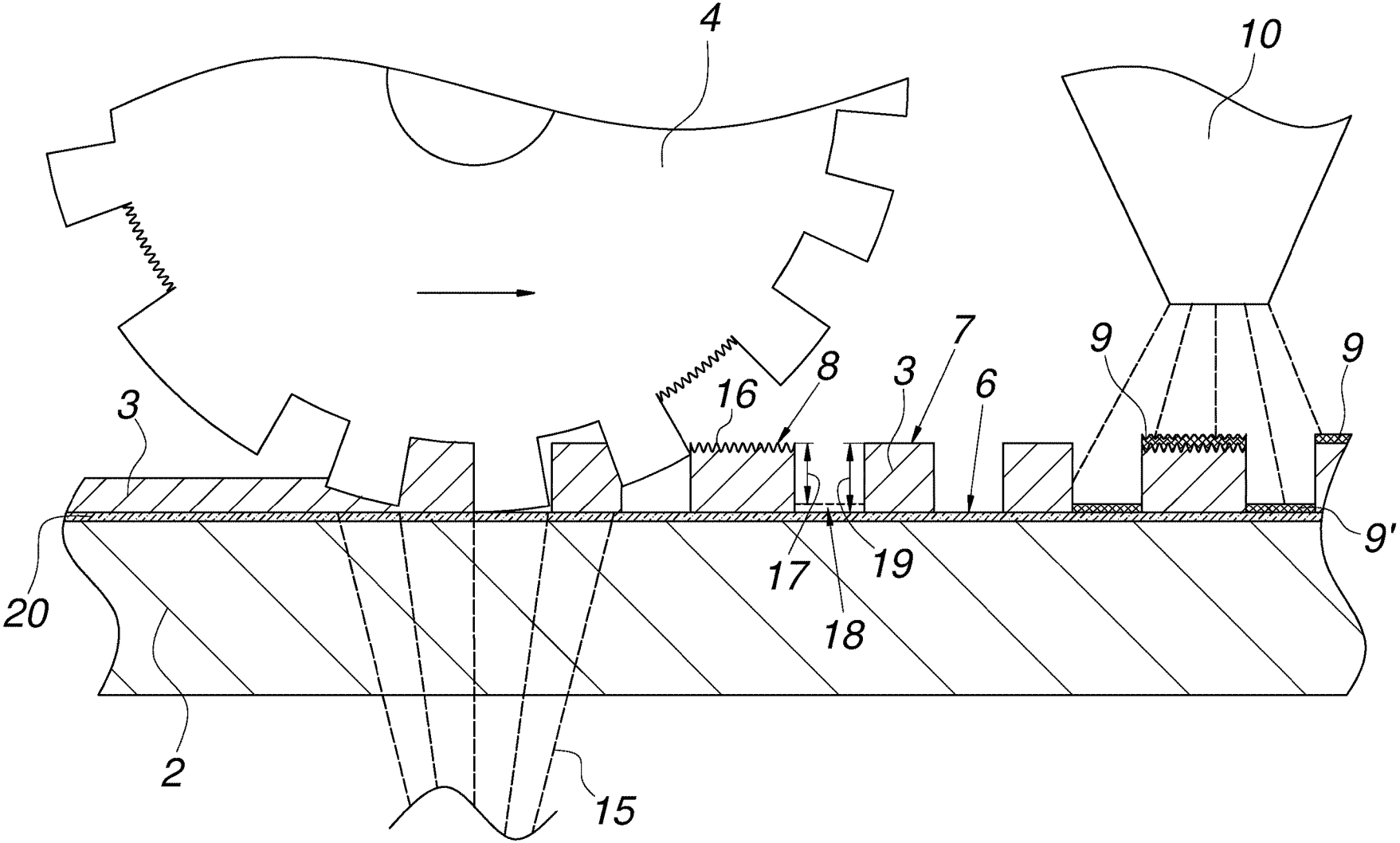
FIG. 3 shows a detail of the embossing procedure of the method from FIG. 1.

The detail view in FIG. 3 shows that optical diffraction structures 8 are embossed into a plurality of structural elevations 7. In particular, these diffraction structures 8 form holograms 16, which constitute a security feature of the security element 1. The embossing depth 17 of the diffraction structures 8 or holograms 16 is advantageously less—and at best significantly less—than the embossing depth 17 of the structural depressions 6 in the embossed coating layer 3. This can significantly facilitate the subsequent separation of the structural depressions 6 from the structural elevations 7 since the remaining coating layer residues 18 in the structural depressions 6 are kept to a minimum. During the separation, remaining coating layer residues 18 could adhere to the structural elevations 7 and prevent the production of an exact, sharp-edged separation. In this connection, it is particularly advantageous if the embossing depth 17 of the structural depressions 6 in the coating layer 3 essentially corresponds to the coating layer thickness 19. In this case, no coating layer residues 18 of any consequence are produced in the structural depressions 6 and as a result, the subsequently applied reflective layer 9 can adhere directly to the underlying layer, for example the support 2.

In order to facilitate the separation of the structural elevations 7 from the structural depressions 6, an adhesion reducer 20 is applied to the support 2 before the coating layer 3. The adhesion reducer 20 is advantageously embodied in such a way that the adhesion force between the support 2 and the coating layer 3 is reduced, but the adhesion force between the support 2 and the reflective layer 9' is increased. During the separation, as shown in FIG. 2, it is thus possible to ensure that the reflective layer 9' reliably adheres to the support 2 and is removed along with it, while the coating layer 3 of the structural elevations 7 remains undamaged.

The transfer support 11 is also coated with an adhesion promoter 21, which increases the adhesion force between the transfer support 11 and the reflective layer 9 of the structural elevations 7. This ensures an integral bond between the reflective layer 9, the structural elevations 7, and the transfer support 11. The separation can thus be carried out in a more reliable and reproducible way.

As shown in FIG. 1, after the separation, the security element 1 is provided with a protective coating layer 22. The protective coating layer 22 can serve both to protect the security element 1 from external influences and to enable a bonding of the security element 1 to additional security features or security documents. In this case, the protective coating 23 that forms the protective coating layer 22 can offer both a protective effect and an adhesive effect for the security element 1.

Other security features that can be bonded to the security element 1 include, for example, holograms, luminescent coatings, metal strips, layers with tilting effects, or the like. The security element 1 can also be mounted onto security documents such as banknotes, credit cards or bank cards, passports, personal ID cards, driver's licenses, etc.

The invention claimed is:

1. A method for producing a security element with a metallized optical diffraction structure in an embossed coating layer, comprising:

applying a coating layer onto a support;

producing structural depressions, structural elevations, and an optical diffraction structure in the coating layer by embossing the coating layer, wherein the optical diffraction structure is embossed into at least one structural elevation;

providing a reflective layer on the structural depressions and structural elevations of the embossed coating layer by applying a metal layer to the structural depressions and structural elevations of the embossed coating layer;

selectively demetallizing the reflective layer, wherein the selective demetallization includes bonding at least the metallized structural elevation that has the optical diffraction structure to a transfer support and then separating the structural elevation bonded to the transfer support both from the support and from at least one metallized structural depression adjoining the structural elevation by removing the transfer support from the support; and curing the coating layer.

2. The method according to claim 1, comprising applying the coating layer to the support in the form of a liquid or a paste and then embossing and curing the coating layer.

3. The method according to claim 2, wherein the coating layer is cured during the embossing.

4. The method according to claim 1, comprising embossing the coating layer with a rotating embossing tool.

5. The method according to claim 1, wherein at least one diffraction structure embossed into a structural elevation produces a hologram.

6. The method according to claim 1, wherein a thickness of the reflective layer is less than an embossing depth of the structural depressions.

7. The method according to claim 1, wherein the optical diffraction structures embossed into the structural elevations have less of an embossing depth than the structural depressions.

8. The method according to claim 1, wherein an embossing depth of the structural depressions in the coating layer essentially corresponds to a thickness of the coating layer.

9. The method according to claim 1, comprising applying an adhesion reducer to the support before applying the coating layer to the support.

10. The method according to claim 1, comprising coating the transfer support with an adhesion promoter before bonding the transfer support to the structural elevations.

11. The method according to claim 1, comprising providing the security element with a protective coating layer after removing the security element from the support.

12. The method according to claim 1, wherein the security element is provided with additional security features.

13. The method according to claim 1, further comprising bonding the security element to a security document.

14. The method according to claim 3, wherein the coating layer is polymerized during the embossing.

* * * * *